United States Patent [19]

Kosmos

[11] 3,969,219

[45] July 13, 1976

[54] ZINC OR CADMIUM ELECTROPLATING BRIGHTENER COMPOSITIONS AND PROCESS

[75] Inventor: John C. Kosmos, Hasbrouck Heights, N.J.

[73] Assignee: Sterling Drug Inc., New York, N.Y.

[22] Filed: Aug. 6, 1975

[21] Appl. No.: 602,247

[52] U.S. Cl. ..... 204/50 Y; 204/DIG. 2; 204/55 Y

[51] Int. Cl.[2] ..... C25D 3/24; C25D 3/28

[58] Field of Search ..... 204/50 Y, 50 R, 55 Y, 204/55 R, DIG. 2

[56] References Cited

UNITED STATES PATENTS 2,740,754 4/1956 Hoffman ..... 204/55 Y 3,850,766 11/1974 Kosmos ..... 204/50 Y

*Primary Examiner*—G. L. Kaplan

*Attorney, Agent, or Firm*—William G. Webb; B. Woodrow Wyatt; Lynn T. Fletcher

[57] ABSTRACT

Electroplating brightener compositions for addition to either alkaline or low, intermediate or high cyanide zinc or cadmium electroplating baths comprising an aqueous solution of corn syrup or glucose, vanillin, veratraldehyde, sodium lignin sulfonate, sodium bisulfite and niacinamide.

12 Claims, No Drawings

ZINC OR CADMIUM ELECTROPLATING BRIGHTENER COMPOSITIONS AND PROCESS

BACKGROUND OF THE INVENTION

1. Field of the Invention

This invention relates to compositions useful as brightener additives to either all alkaline or low, intermediate or high cyanide zinc or cadmium electroplating baths containing corn syrup or glucose, vanillin, veratraldehyde, sodium lignin sulfonate, sodium bisulfite and niacinamide and to processes of bright electroplating using said compositions.

2. Description of the Prior Art

It is known in the art to use as brighteners in electroplating baths such materials as waste sulfite liquors (U.S. Pat. No. 1,544,726); various sulfonic acid derivatives (including the alkali metal salts thereof) such as alkylsubstituted-aromatic sulfonic acids (U.S. Pat. No. 2,312,097), sulfonic acid derivatives of phenols (U.S. Pat. No. 1,607,870); lignin sulfonic acid and metal salts thereof including the sodium salt (U.S. Pat. Nos. 2,740,754; 2,872,392 and 3,146,178); certain aromatic aldehydes such as anisic aldehyde (U.S. Pat. No. 2,740,754); and various proteins, such as peptone (U.S. Pat. No. 2,799,635) or hydrolyzed meat protein (U.S. Pat. No. 3,751,348).

Moreover, my prior U.S. Pat. No. 3,850,766, patented Nov. 26, 1974, describes and claims electroplating brightener compositions for addition to alkaline cyanide zinc or cadmium electroplating baths containing corn syrup or glucose, vanillin, veratraldehyde, sodium lignin sulfonate and sodium bisulfite in an aqueous medium.

SUMMARY OF THE INVENTION

In a composition aspect, the invention relates to an electroplating brightener composition for addition to zinc or cadmium electroplating baths comprising an aqueous solution containing corn syrup or glucose, vanillin, veratraldehyde, sodium lignin sulfonate and niacinamide (i.e. pyridine-3-carboxamide).

In a process aspect, the invention relates to a process for bright plating of zinc or cadmium from aqueous cyanide electroplating baths which comprises adding to said baths an aqueous composition containing corn syrup or glucose, vanillin, veratraldehyde, sodium lignin sulfonate and niacinamide.

DETAILED DESCRIPTION INCLUSIVE OF THE PREFERRED EMBODIMENTS

More specifically, this invention relates to compositions for use as brightener additives containing, in addition to the ingredients described in my prior U.S. Pat. No. 3,850,766, niacinamide. As described in the patent, although each of the ingredients of the patented composition when used separately as brightener additives has some brightening effect, other properties of the separate ingredients make them unsuitable as electroplating brighteners. Yet when the ingredients are combined, a brightener additive for electroplating baths is obtained which provides advantages, in terms of brightening effect, tolerance to impurities, extended bath life and adherence, and usefulness over a broad range of current densities, in comparison with the separate ingredients when used alone.

It has now been found that the addition of niacinamide to the patented composition provides even greater advantages, not only over each of the separate ingredients but also over the patented composition as well, in terms of providing a wider range of current densities; providing a more uniform fine grained crystal structure throughout the preferred current density range, free from occluded hydrolysis products; in being suitable for use not only in alkaline cyanide baths as is the patented composition, but also being useful in low, intermediate or high cyanide cadmium or zinc electroplating baths as well; and in providing greater tolerance to organic impurities.

Like the electroplating compositions described and claimed in U.S. Pat. No. 3,850,766, the bath additive compositions useful in the practice of the present invention can, if desired, be used in conjunction with other agents known to provide added brilliance to the electrodeposit such as molybdate salts, for example ammonium heptamolybdate, or with polysulfides in the case of cyanide zinc baths, for example ammonium, sodium or potassium polysulfide, which are used to combine with metallic impurities in the electroplating bath and thereby serve to prevent impurities from interfering with deposition of the pure metal.

The bath additive compositions provided by the present invention are preferably prepared in concentrated form, and in use are further diluted with water for addition to new or old working electroplating solutions in amounts to be described hereinafter. The concentrated form contains from 1.0 to 4.3 pounds/gallon of sodium lignin sulfonate, about 0.9 pound/gallon of veratraldehyde, from 0.1 to 2.2 pounds/gallon of vanillin, from 1.5 to 4.5 pounds/gallon of corn syrup or glucose, a molar equivalent amount of sodium bisulfite corresponding to the total weight of the vanillin and veratraldehyde, and from 0.1 to 2.0 ounces/gallon (or 0.00625 to 0.125 pound/gallon) of niacinamide. Since, as will be described hereinafter, the additive compositions can be made up in varying concentrations ranging from dilute solutions that can be added directly to the plating bath to more concentrated solutions that require further dilution before addition to the plating bath, the compositions can also be described in terms of the relative amounts of the separate ingredients. Thus, relative to the veratraldehyde present, the operative amounts of the separate ingredients, expressed in parts by weight, are:

| | |
|---|---|
| Sodium lignin sulfonate | 1.1–4.8 |
| Veratraldehyde | 1.0 |
| Vanillin | 0.1–2.5 |
| Corn syrup or glucose | 1.7–5.0 |
| Niacinamide | 0.007–0.14 |

and a molar equivalent amount of sodium bisulfite corresponding to the total molar equivalent amount of the vanillin and veratraldehyde.

The compositions can be used in either barrel or still plating procedures, and when employed in barrel or still plating of cadmium, they may optionally contain, in addition to the ingredients described above, from 0.018 to 0.4 pound/gallon of ammonium heptamolybdate (or from 0.02 to 0.4 part by weight relative to veratraldehyde) to improve the brilliance of the deposit. When employed in barrel or still plating of zinc, they may optionally contain, respectively, from 0.018 to 0.4 pound/gallon (0.02 to 0.4 part by weight relative to veratraldehyde) or from 0.015 to 0.18 pound/gallon (0.017 to 0.2 part by weight relative to veratraldehyde) of ammonium heptamolybdate.

A preferred composition contains from 1.35 to 3.2 pounds/gallon of sodium lignin sulfonate, 0.9 pound/gallon of veratraldehyde, from 0.18 to 1.35 pounds/gallon of vanillin, from 2.0 to 4.0 pounds/gallon of corn syrup or glucose, a molar equivalent amount of sodium bisulfite equal to the total amount of vanillin and veratraldehyde, and 0.5 to 2.0 ounces/gallon (or 0.031 to 0.125 pounds/gallon) of niacinamide. When ammonium heptamolybdate is used to enhance the brilliance of the deposit in cadmium barrel or still plating, it is preferred to use from 0.045 to 0.27 pound/gallon of the heptamolybdate, and when the heptamolybdate is used in barrel or still plating of zinc, it is preferred to use, respectively, from 0.045 to 0.27 pound/gallon or from 0.018 to 0.18 pound/gallon of the heptamolybdate. Expressed in parts by weight relative to veratraldehyde, the preferred composition contains:

| | |
|---|---|
| Sodium lignin sulfonate | 1.5–3.5 |
| Veratraldehyde | 1.0 |
| Vanillin | 0.2–1.5 |
| Corn syrup or glucose | 2.2–4.5 |
| Niacinamide | 0.035–0.14 |

and a molar equivalent amount of sodium bisulfite equal to the total amount of vanillin and veratraldehyde. When ammonium heptamolybdate is used in barrel or still plating of cadmium or in barrel plating of zinc, a preferred amount is from 0.05 to 0.3 part by weight relative to the veratraldehyde, and when it is used in still plating of zinc, a preferred amount is from 0.02 to 0.2 part by weight relative to veratraldehyde.

In use, the concentrates described above are diluted with three parts of water and added to the electroplating bath. In the case of new baths, an amount of the so-diluted solution to provide 1–2% by volume of the final plating solution is used, whereas in the case of old working baths, it is sufficient to add ½% by volume of the diluted concentrate.

The compositions of the invention, when used in barrel plating of cadmium, give best results at (6–15) volts E.M.F., while in barrel plating of zinc, best results are obtained at (6–18) volts E.M.F. In still plating of cadmium, a current density of (2–90) amperes/ft$^2$ can be used with advantage, a current density of (5–60) amperes/ft$^2$ being preferred. In still plating of zinc, good results are obtained at current densities of (5–90) amperes/ft$^2$, a preferred range being (10–60) amperes/ft$^2$. In all cases, plating is advantageously carried out at temperatures from 70°–90°F.

Having described the general manner of making and using the invention, the best mode of carrying out the invention is described by the following specific examples.

Example 1 Basic Concentrate

A concentrate containing the following ingredients:

| | |
|---|---|
| Sodium lignin sulfonate | 1.49 pounds/gal. |
| Veratraldehyde | 0.9 pound/gal. |
| Vanillin | 0.6 pound/gal. |
| Corn syrup | 2.08 pounds/gal. |
| Niacinamide | 2.0 ounces/gal. |
| Sodium bisulfite | 0.84 pound/gal. |

is prepared as follows:

A container of adequate size is charged with about 40% of the necessary quantity of water at 140°–150°F., and the sodium lignin sulfonate is added with stirring, followed by the corn syrup which is previously warmed to about 120°F. The vanillin and veratraldehyde are liquified by warming together on a hot water bath, and the liquid melt is added to the main mixture with stirring. The sodium bisulfite is then added slowly with stirring until all material is dissolved, and the niacinamide added and stirred until all material is dissolved. Sufficient water is added to give the desired final volume, the solution is cooled to below 100°F., and then packed with stirring in polyethylene containers.

A. Zinc Barrel or Still Plating Composition

The concentrate so-prepared is diluted with three parts of water, and 10 to 20 gallons of the diluted solution are added to 1,000 gallons of a standard zinc cyanide bath containing:

| | |
|---|---|
| Zinc cyanide | 8.0 oz./gal. |
| Sodium cyanide | 5.6 oz./gal. |
| Sodium hydroxide | 8–10 oz./gal. |
| Sodium polysulfide | 0.12 oz./gal. |

The so-prepared bath when used in barrel plating at (6–18) volts E.M.F. at 70°–90°F. for 20–25 minutes gives an even, bright deposit of about 0.0002 inch thickness.

The same bath when used in still plating at a current density of (5–60) amperes/ft$^2$ at 70°–90°F. for 6–10 minutes gives an even, bright deposit of 0.0002 inch thickness.

The deposit so-obtained is distinguished from that obtained under similar conditions using a bath similarly constituted except lacking the niacinamide in that a more uniform fine grained crystal structure is developed, free from occluded hydrolysis products.

B. Cadmium Barrel Plating Composition

The concentrate described in Example 1 above is diluted with three parts of water, and 10–20 gallons of the diluted solution are added to 1,000 gallons of a cadmium barrel plating solution containing:

| | |
|---|---|
| Cadmium oxide | 3.0 oz./gal. |
| Sodium cyanide | 10.4–13.4 oz./gal. |
| Sodium hydroxide | 1.0 oz./gal. |

The bath so-prepared, when used in the barrel plating of cadmium at (9–12) volts E. M. F. at 70°–90°F. for 10–15 minutes gives an even, bright deposit of about 0.0002 inch thickness.

The bath so-prepared, when used in the barrel plating of cadmium at (9–12) volts E.M.F. at 70°–90°F. for 10–15 minutes gives an even, bright deposit of about 0.0002 inch thickness.

The deposit so-obtained is distinguished from that obtained under similar conditions using a bath similarly constituted except lacking the niacinamide in that a more uniform fine grained crystal structure is developed, free from occluded hydrolysis products.

C. Cadmium Still Plating Composition

The concentrate described in Example 1 above is diluted with three parts of water, and 10–20 gallons of the diluted solution are added to 1,000 gallons of a cadmium still plating solution containing:

| | |
|---|---|
| Cadmium oxide | 3.0 oz./gal. |
| Sodium cyanide | 10.4–13.4 oz./gal. |

The bath so-prepared, when used in the still plating of cadmium at (5–60) amperes/ft$^2$ at 70°–90°F. for 5 minutes gives an even, bright deposit of about 0.0002 inch thickness.

The deposit so-obtained is distinguished from that obtained under similar conditions using a bath similarly constituted except lacking the niacinamide in that a more uniform fine grained crystal structure is developed, free from occluded hydrolysis products.

Example 2

To the basic concentrate described in Example 1 above is added 0.06 pound/gallon (about 4 grams/liter) of ammonium heptamolybdate. The concentrate so-obtained is diluted with three parts of water, and 10–20 gallons of the diluted solution are added, respectively, to 1,000 gallons of the solutions described in Examples 1B and 1C above. The baths so-obtained in each case when used, respectively, in barrel plating and still plating of cadmium under the conditions described in Examples 1B and 1C, respectively, give deposits similar to those described in Examples 1B and 1C, respectively, but having improved brilliance thereover.

The deposit so-obtained is distinguished from that obtained under similar conditions using a bath similarly constituted except lacking the niacinamide in that a more uniform fine grained crystal structure is developed, free from occluded hydrolysis products.

Example 3

To the basic concentrate described in Example 1 above is added 0.03 pound/gallon (about 2 grams/liter) of ammonium heptamolybdate. The concentrate so-obtained is diluted with three parts of water, and 10–20 gallons of diluted solution are added to 1,000 gallons of the solution described in Example 1A above. The bath so-obtained when used in still plating of zinc under the conditions described in Example 1A gives a deposit similar to that described in Example 1A but having improved brilliance thereover.

The deposit so-obtained is distinguished from that obtained under similar conditions using a bath similarly constituted except lacking the niacinamide in that a more uniform fine grained crystal structure is developed, free from occluded hydrolysis products.

Example 4

To the basic concentrate described in Example 1 is added 0.06 pound/gallon (about 4 grams/liter) of ammonium heptamolydate. The concentrate so-obtained is diluted with three parts of water, and 10–20 gallons of the diluted solution are added to 1,000 gallons of the solution described in Example 1A above. The bath so-obtained when used in barrel plating of zinc under the conditions described in Example 1A gives a deposit similar to that obtained in Example 1A but having improved brilliance thereover.

The deposit so-obtained is distinguished from that obtained under similar conditions using a bath similarly constituted except lacking the niacinamide in that a more uniform fine grained crystal structure is developed, free from occluded hydrolysis products.

I claim:

1. In a process for bright plating of zinc or cadmium from aqueous alkaline cyanide electroplating baths, the improvement which comprises adding to said baths an aqueous composition containing, in parts by weight:

| | |
|---|---|
| Sodium lignin sulfonate | 1.1–4.8 |
| Veratraldehyde | 1.0 |

-continued

| | |
|---|---|
| Vanillin | 0.1–2.5 |
| Corn syrup or glucose | 1.7–5.0 |
| Niacinamide | 0.007–0.14 |

and a molar equivalent amount of sodium bisulfite equal to the total molar equivalent amount of the vanillin and veratraldehyde.

2. In a process for barrel or still bright plating of cadmium or barrel plating of zinc from aqueous alkaline cyanide electroplating baths, the improvement which comprises adding to said baths an aqueous composition containing, in parts by weight:

| | |
|---|---|
| Sodium lignin sulfonate | 1.1–4.8 |
| Veratraldehyde | 1.0 |
| Vanillin | 0.1–2.5 |
| Corn syrup or glucose | 1.7–5.0 |
| Niacinamide | 0.007–0.14 |
| Ammonium heptamolybdate | 0.02–0.4 |

and a molar equivalent amount of sodium bisulfite equal to the total molar equivalent amount of the vanillin and veratraldehyde.

3. In a process for still bright plating of zinc from aqueous alkaline cyanide electroplating baths, the improvement which comprises adding to said baths an aqueous composition containing, in parts by weight:

| | |
|---|---|
| Sodium lignin sulfonate | 1.1–4.8 |
| Veratraldehyde | 1.0 |
| Vanillin | 0.1–2.5 |
| Corn syrup or glucose | 1.7–5.0 |
| Niacinamide | 0.007–0.14 |
| Ammonium heptamolybdate | 0.017–0.2 |

and a molar equivalent amount of sodium bisulfite equal to the total molar equivalent amount of the vanillin and veratraldehyde.

4. A process according to claim 1 wherein the bath additive composition contains, in parts by weight:

| | |
|---|---|
| Sodium lignin sulfonate | 1.5–3.5 |
| Veratraldehyde | 1.0 |
| Vanillin | 0.2–1.5 |
| Corn syrup or glucose | 2.2–4.5 |
| Niacinamide | 0.035–0.14 |

and a molar equivalent amount of sodium bisulfite equal to the total molar equivalent amount of the vanillin and veratraldehyde.

5. A process according to claim 2 wherein the bath additive composition contains, in parts by weight:

| | |
|---|---|
| Sodium lignin sulfonate | 1.5–3.5 |
| Veratraldehyde | 1.0 |
| Vanillin | 0.2–1.5 |
| Corn syrup or glucose | 2.2–4.5 |
| Niacinamide | 0.035–0.14 |
| Ammonium heptamolybdate | 0.05–0.3 |

and a molar equivalent amount of sodium bisulfite equal to the total molar equivalent amount of the vanillin and veratraldehyde.

6. A process according to claim 3 wherein the bath additive composition contains, in parts by weight:

| | |
|---|---|
| Sodium lignin sulfonate | 1.5–3.5 |
| Veratraldehyde | 1.0 |
| Vanillin | 0.2–1.5 |
| Corn syrup or glucose | 2.2–4.0 |
| Niacinamide | 0.035–0.14 |
| Ammonium heptamolybdate | 0.02–0.2 |

and a molar equivalent amount of sodium bisulfite equal to the total molar equivalent amount of the vanillin and veratraldehyde.

7. An electroplating brightener composition for addition to zinc or cadmium alkaline cyanide electroplating baths comprising an aqueous solution containing, in parts by weight:

| | |
|---|---|
| Sodium lignin sulfonate | 1.1–4.8 |
| Veratraldehyde | 1.0 |
| Vanillin | 0.1–2.5 |
| Corn syrup or glucose | 1.7–5.0 |
| Niacinamide | 0.007–0.14 |

and a molar equivalent amount of sodium bisulfite equal to the total molar equivalent amount of the vanillin and veratraldehyde.

8. An electroplating brightener composition for addition to cadmium barrel or still plating or zinc barrel plating alkaline cyanide electroplating baths comprising an aqueous solution containing, in parts by weight:

| | |
|---|---|
| Sodium lignin sulfonate | 1.1–4.8 |
| Veratraldehyde | 1.0 |
| Vanillin | 0.1–2.5 |
| Corn syrup or glucose | 1.7–5.0 |
| Niacinamide | 0.007–0.14 |
| Ammonium heptamolybdate | 0.02–0.4 |

and a molar equivalent amount of sodium bisulfite equal to the total molar equivalent amount of the vanillin and veratraldehyde.

9. An electroplating brightener composition for addition to zinc still plating alkaline cyanide electroplating baths comprising an aqueous solution containing, in parts by weight:

| | |
|---|---|
| Sodium lignin sulfonate | 1.1–4.8 |
| Veratraldehyde | 1.0 |
| Vanillin | 0.1–2.5 |
| Corn syrup or glucose | 1.7–5.0 |
| Niacinamide | 0.007–0.14 |

-continued

| | |
|---|---|
| Ammonium heptamolybdate | 0.017–0.2 |

and a molar equivalent amount of sodium bisulfite equal to the total molar equivalent amount of the vanillin and veratraldehyde.

10. A composition according to claim 7 containing, in parts by weight:

| | |
|---|---|
| Sodium lignin sulfonate | 1.5–3.5 |
| Veratraldehyde | 1.0 |
| Vanillin | 0.2–1.5 |
| Corn syrup or glucose | 2.2–4.5 |
| Niacinamide | 0.035–0.14 |

and a molar equivalent amount of sodium bisulfite equal to the total molar equivalent amount of the vanillin and veratraldehyde.

11. A composition according to claim 8 containing, in parts by weight:

| | |
|---|---|
| Sodium lignin sulfonate | 1.5–3.5 |
| Veratraldehyde | 1.0 |
| Vanillin | 0.2–1.5 |
| Corn syrup or glucose | 2.2–4.5 |
| Niacinamide | 0.035–0.14 |
| Ammonium heptamolybdate | 0.05–0.3 |

and a molar equivalent amount of sodium bisulfite equal to the total molar equivalent amount of the vanillin and veratraldehyde.

12. A composition according to claim 9 containing, in parts by weight:

| | |
|---|---|
| Sodium lignin sulfonate | 1.5–3.5 |
| Veratraldehyde | 1.0 |
| Vanillin | 0.2–1.5 |
| Corn syrup or glucose | 2.2–4.0 |
| Niacinamide | 0.035–0.14 |
| Ammonium heptamolybdate | 0.02–0.2 |

and a molar equivalent amount of sodium bisulfite equal to the total molar equivalent amount of the vanillin and veratraldehyde.

* * * * *